US005562319A

United States Patent [19]

Kohler

[11] Patent Number: 5,562,319

[45] Date of Patent: Oct. 8, 1996

[54] ANIMAL WASTE RETRIEVAL DEVICE

[76] Inventor: Hugh F. Kohler, 1216 Fairway Oaks Ave., Banning, Calif. 92220

[21] Appl. No.: 456,477

[22] Filed: Jun. 1, 1995

[51] Int. Cl.[6] ..... A01K 29/00; E01H 1/12

[52] U.S. Cl. ..... 294/1.4

[58] Field of Search ..... 294/1.3, 1.4, 1.5, 294/19.1, 55; 15/257.1, 257.2, 104.8; 43/87

[56] References Cited

U.S. PATENT DOCUMENTS

| | | | |
|---|---|---|---|
| 3,777,708 | 12/1973 | Vogt | 294/1.5 |
| 3,802,728 | 4/1974 | Giacopelli | 294/1.4 |
| 3,977,422 | 8/1976 | Cabaluna | 294/1.4 |
| 3,984,139 | 10/1976 | Battaglia | 294/1.4 |
| 4,003,595 | 1/1977 | Fano et al. | 294/1.5 |
| 4,225,174 | 9/1980 | Hennessy et al. | 294/1.4 |
| 5,269,575 | 12/1993 | Parvaresh | 294/1.5 |

FOREIGN PATENT DOCUMENTS

| | | | |
|---|---|---|---|
| 2660524 | 10/1991 | France | 294/1.5 |

*Primary Examiner*—Dean Kramer

[57] ABSTRACT

A device for retrieving and containing animal waste from a ground surface. The inventive device includes a handle tube supporting an inverted bag at a lower end thereof. A manually operable closure assembly includes a snare loop extending about a mouth of the bag for closing the mouth of the bag when positioned over a quantity of animal waste to retrieve and secure the waste within the bag.

6 Claims, 4 Drawing Sheets

FIG 5
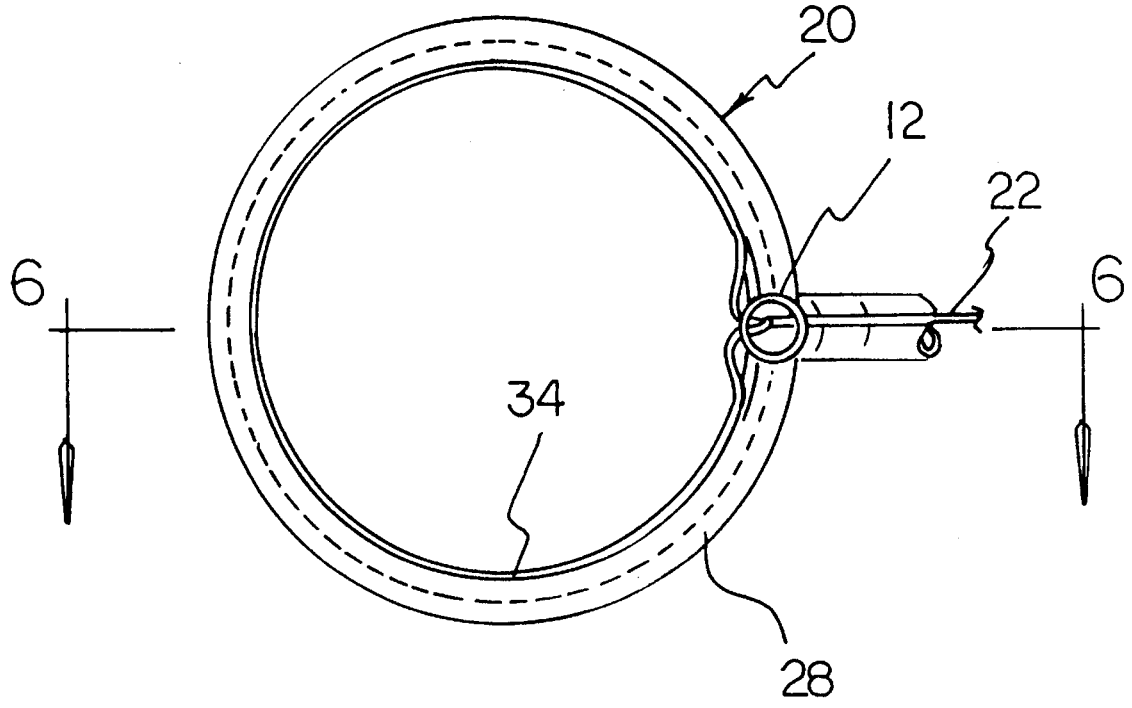
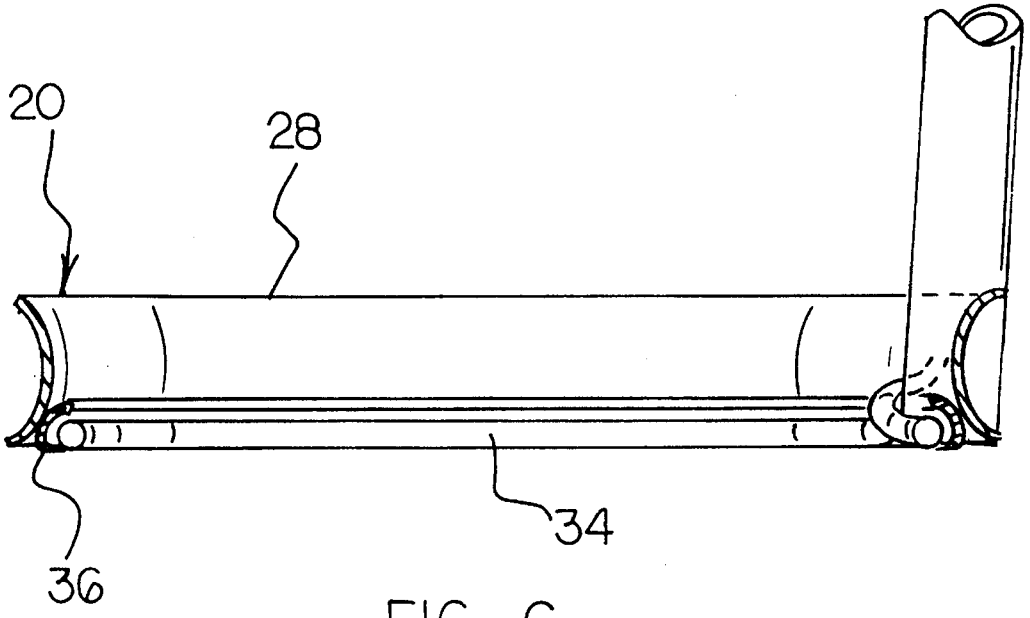
FIG 6

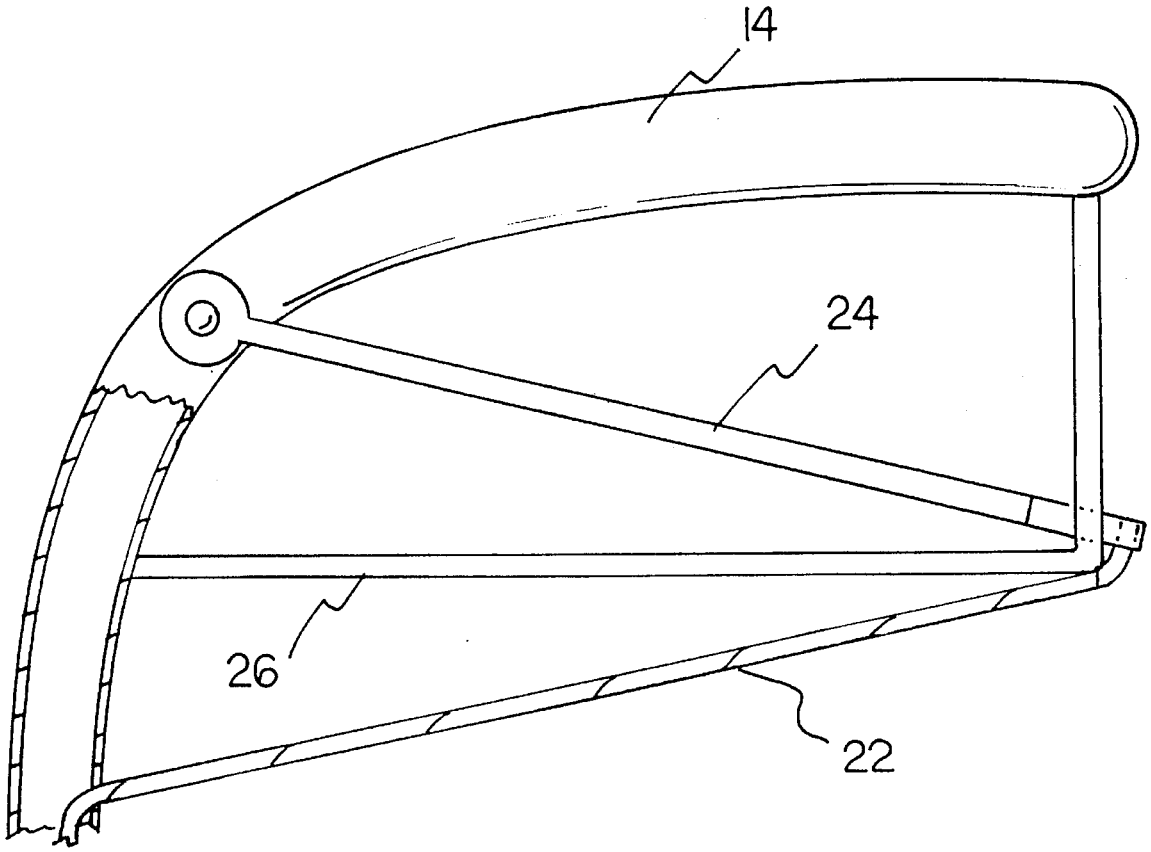
FIG 7
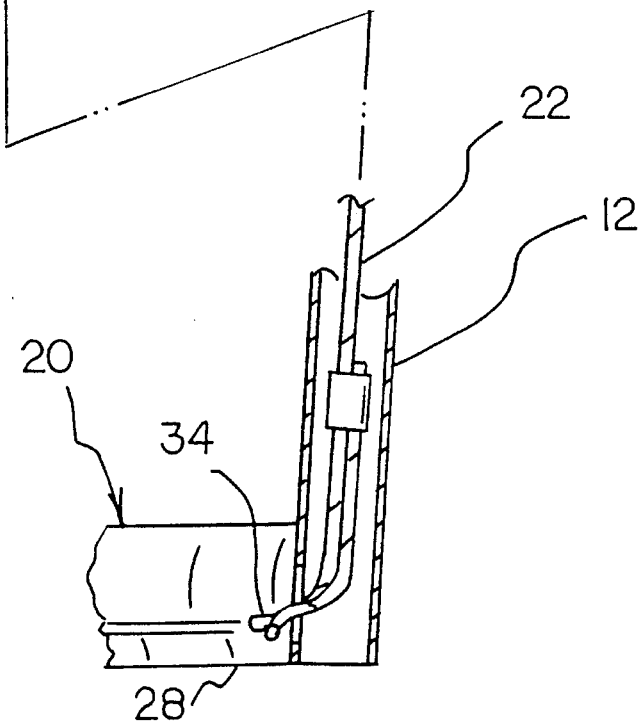

ANIMAL WASTE RETRIEVAL DEVICE

BACKGROUND OF THE INVENTION

1. Field of the Invention

The present invention relates to cleaning implements and more particularly pertains to an animal waste retrieval device for retrieving and containing animal waste from a ground surface.

2. Description of the Prior Art

The use of cleaning implements is known in the prior art. More specifically, cleaning implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning implements include U.S. Pat. No. 5,236,237; U.S. Pat. No. 4,995,661; U.S. Pat. No. 4,854,624; U.S. Pat. No. 5,290,080; U.S. Pat. No. 5,054,828; and U.S. Design Patent 334,255.

While these devices fulfill their respective, particular objectives and requirements, the aforementioned patents do not disclose an animal waste retrieval device for retrieving and containing animal waste from a ground surface which includes a handle tube supporting an inverted bag at a lower end thereof, and a manually operable closure assembly including a snare loop extending about a mouth of the bag for closing the bag when positioned over a quantity of animal waste to retrieve and secure the waste within the bag.

In these respects, the animal waste retrieval device according to the present invention substantially departs from the conventional concepts and designs of the prior art, and in so doing provides an apparatus primarily developed for the purpose of retrieving and containing animal waste from a ground surface.

SUMMARY OF THE INVENTION

In view of the foregoing disadvantages inherent in the known types of cleaning implements now present in the prior art, the present invention provides a new animal waste retrieval device construction wherein the same can be utilized for retrieving and containing animal waste from a ground surface. As such, the general purpose of the present invention, which will be described subsequently in greater detail, is to provide a new animal waste retrieval device apparatus and method which has many of the advantages of the cleaning implements mentioned heretofore and many novel features that result in an animal waste retrieval device which is not anticipated, rendered obvious, suggested, or even implied by any of the prior art cleaning implements, either alone or in any combination thereof.

To attain this, the present invention generally comprises a device for retrieving and containing animal waste from a ground surface. The inventive device includes a handle tube supporting an inverted bag at a lower end thereof. A manually operable closure assembly includes a snare loop extending about a mouth of the bag for closing the mouth of the bag when positioned over a quantity of animal waste to retrieve and secure the waste within the bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new animal waste retrieval device apparatus and method which has many of the advantages of the cleaning implements mentioned heretofore and many novel features that result in an animal waste retrieval device which is not anticipated, rendered obvious, suggested, or even implied by any of the prior art tool guides, either alone or in any combination thereof.

It is another object of the present invention to provide a new animal waste retrieval device which may be easily and efficiently manufactured and marketed.

It is a further object of the present invention to provide a new animal waste retrieval device which is of a durable and reliable construction.

An even further object of the present invention is to provide a new animal waste retrieval device which is susceptible of a low cost of manufacture with regard to both materials and labor, and which accordingly is then susceptible of low prices of sale to the consuming public, thereby making such animal waste retrieval devices economically available to the buying public.

Still yet another object of the present invention is to provide a new animal waste retrieval device which provides in the apparatuses and methods of the prior art some of the advantages thereof, while simultaneously overcoming some of the disadvantages normally associated therewith.

Still another object of the present invention is to provide a new animal waste retrieval device for retrieving and containing a quantity of animal waste from a ground surface.

Yet another object of the present invention is to provide a new animal waste retrieval device which includes a handle tube supporting an inverted bag at a lower end thereof, and a manually operable closure assembly including a snare loop extending about a mouth of the bag for closing the bag when positioned over a quantity of animal waste to retrieve and secure the waste within the bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a bottom plan view of the invention as viewed from line 5—5 of FIG. 4.

FIG. 6 is a cross-sectional view taken along line 6—6 of FIG. 5.

FIG. 7 is an enlarged side elevation view, partially in cross-section, of portions of the invention.

DESCRIPTION OF THE PREFERRED EMBODIMENT

Figure 1:
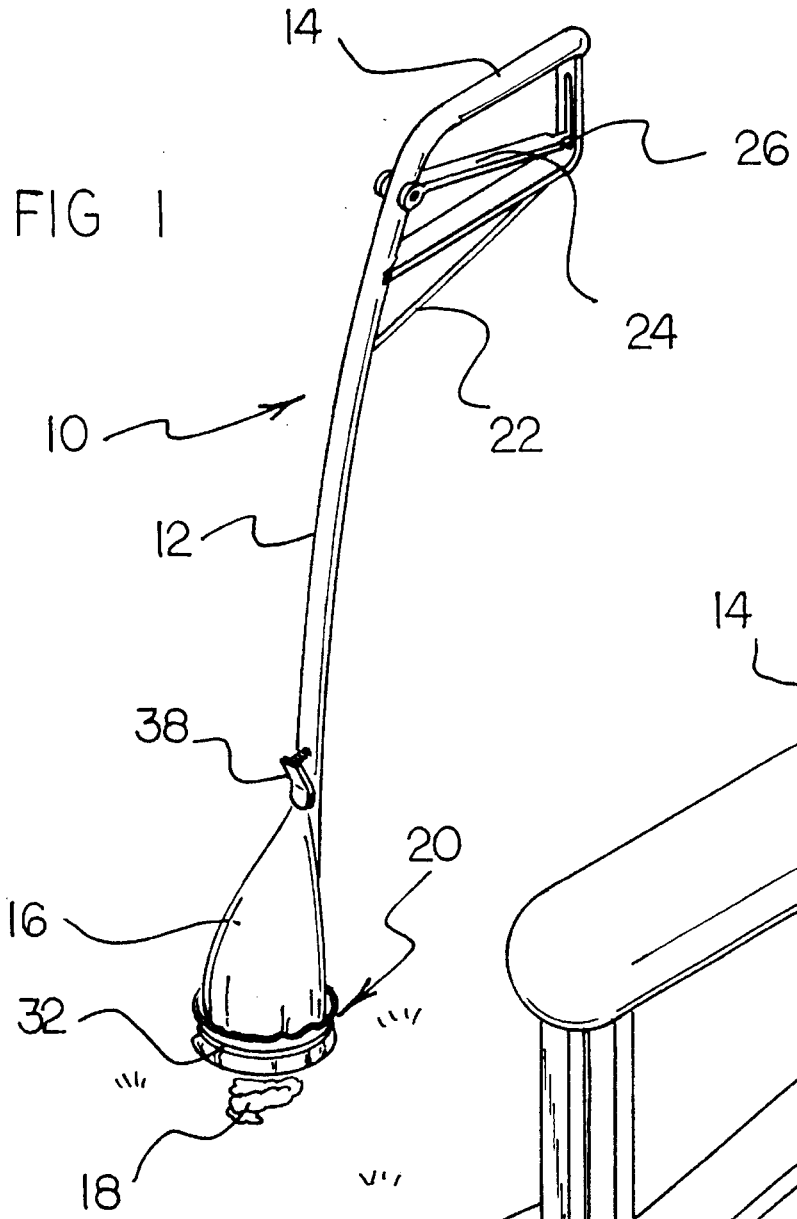
FIG. 1 is an isometric illustration of an animal waste retrieval device according to the present invention.

With reference now to the drawings, and in particular to FIGS. 1–7 thereof, a new animal waste retrieval device embodying the principles and concepts of the present invention and generally designated by the reference numeral 10 will be described.

More specifically, it will be noted that the animal waste retrieval device 10 comprises an elongated handle tube 12 having a handle grip 14 coupled to an upper end thereof for facilitating manual grasping and manipulating of the handle tube during use of the device 10. A bag 16 is removably coupled to a lower end of the handle tube 12 and can be manipulated thereby so as to be positioned over a quantity of animal waste 18 and residing upon a ground surface, as shown in FIG. 1 of the drawings. A closure means 20 is mounted to the lower end of the handle tube 12 and operates to permit remote manual closing of the bag 16 when positioned over the animal waste 18 so as to capture and retain the animal waste within the bag. By this structure, an individual can easily and efficiently retrieve animal waste 18 from a ground surface in a sanitary manner.

Figure 2:
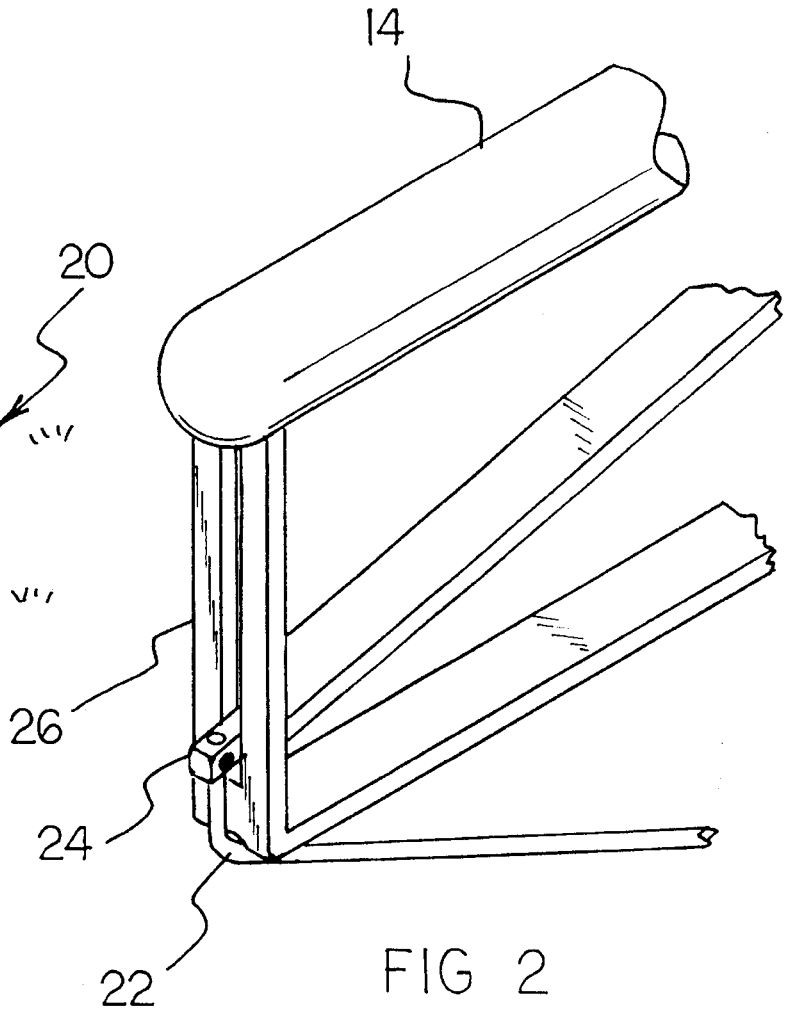
FIG. 2 is an enlarged isometric illustration of a portion of the present invention.

The closure means 20 is mechanically operated by a tension cable 22 which can be selectively manually tensioned to effect operation of the closure means. To this end, the tension cable 22 extends partially through the handle tube 12 and extends therefrom to couple with an actuator 24 which is pivotally mounted proximal to the handle grip 14. A guide member 26 guides both the actuator 24 and the tension cable 22 such that a pivoting of the actuator 24 towards the handle grip 14 will effect tensioning of the tension cable 22 to operate the closure means 20, as is best illustrated in FIGS. 2 and 7 of the drawings.

Figure 3:
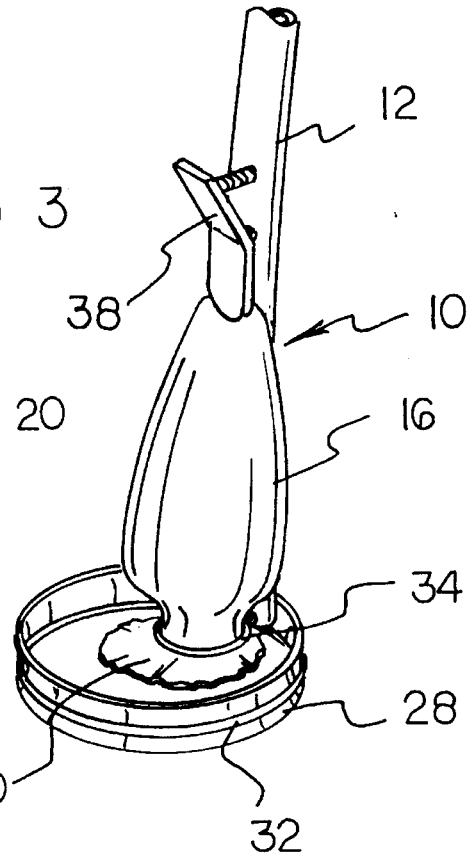
FIG. 3 is an isometric illustration of a further portion of the present invention.

Referring now to FIGS. 3 through 6 wherein the present invention 10 is illustrated in detail, it can be shown that the closure means 20 of the present invention 10 preferably comprises a support ring 28 mounted to a lower end of the handle tube 12. The bag 16 is positioned within the support ring 28, and opened such that a mouth 30 of the bag is wrapped about the support ring 28. An elastic band 32 secures the open mouth 30 to the support ring 28, as best illustrated in FIG. 1 of the drawings. The closure means 20 further comprises a snare loop 34 extending along an interior surface of the support ring 28 which can be constricted about the mouth 30 of the bag 16 so as to close the bag and effect simultaneous separation of the mouth of the bag from the exterior of the support ring 28 and the elastic band 32 extending thereabout, as shown in FIG. 3. To effect constricting of the snare loop 34 about the mouth 30 of the bag 16, the snare loop 34 is coupled to the tension cable 22 and extends through an aperture in the lower end of the handle tube 12 such that tensioning of the tension cable 22 will effect drawing of the snare loop 34 into the handle tube 12, thereby decreasing a diameter of the snare loop 34 to close the bag 16 as shown in FIG. 3 of the drawings. To support the snare loop 34 in a desired position within the support ring 28, an annular guide 36 extends about an interior surface of the support ring. The snare loop 34 is thus positioned into the annular guide 36, with the bag 16 being positioned within the snare loop 34 and operating to simultaneously retain the snare loop 34 within the annular guide 36. By this structure, the snare loop 34 is supported within the support ring 28 proximal to the lower edge of the support ring 28 such that the snare loop 34 closely engages a ground surface during use of the device 10.

Figure 4:
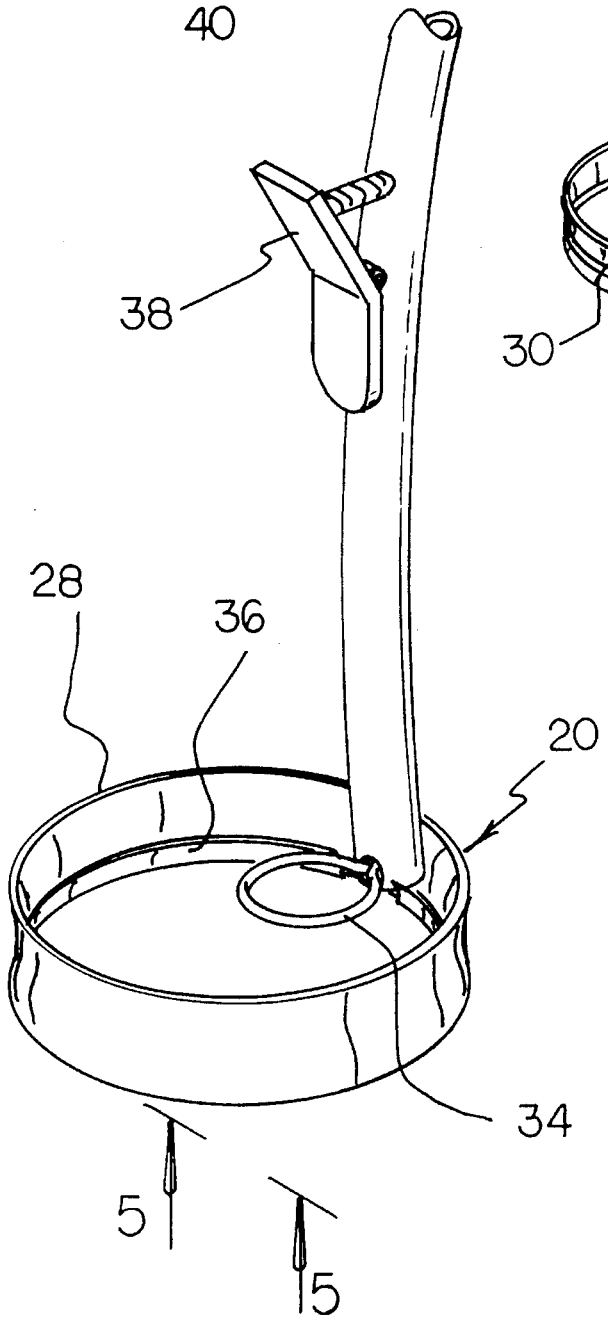
FIG. 4 is an enlarged isometric illustration of the portion of the invention illustrated in FIG. 3 with a bag of the invention removed.

As best illustrated in FIGS. 3 and 4, it can be shown that the bag 16 is preferably supported at a closed upper end thereof relative to the handle tube 12 by a retaining clip 38 which is pivotally mounted to the handle tube and biased into a closed position by a coil spring 40 extending between the retaining clip 38 and an exterior surface of the handle tube 12. By this structure, the bag 16 can be supported in an open position for reception of the animal waste 18 therewithin during use of the device 10.

In use, the animal waste retrieval device 10 according to the present invention can be easily utilized to effect retrieving and capturing of a quantity of animal waste 18 within a bag 16. The bag 16 can be constructed of a disposable material or the like such that the closed bag containing the animal waste 18 can simply be disposed of subsequent to use of the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An animal waste retrieval device comprising:

an elongated handle tube having a handle grip coupled to an upper end thereof for facilitating manual grasping and manipulating of the handle tube;

a bag removably coupled to a lower end of the handle tube;

a closure means mounted to the lower end of the handle tube for permitting remote manual closing of the bag when positioned over animal waste to capture and retain the animal waste within the bag;

wherein the closure means is mechanically operated by a tension cable extending through the handle tube which can be selectively manually tensioned to effect operation of the closure means;

and further comprising an actuator pivotally mounted proximal to the handle grip, with the tension cable being coupled to the actuator;

wherein the closure means comprises a support ring mounted to a lower end of the handle tube, the bag being positioned within the support ring and opened such that an open mouth of the bag is wrapped about the support ring; and elastic band securing the open mouth to the support ring; a snare loop extending along an interior surface of the support ring which can be constricted about the mouth of the bag so as to close the bag and effect simultaneous separation of the mouth of the bag from the exterior of the support ring and the elastic band extending thereabout.

2. The animal waste retrieval device of claim 1, wherein the snare loop is coupled to the tension cable and extends through an aperture in the lower end of the handle tube such that tensioning of the tension cable will effect drawing of the snare loop into the handle tube, thereby decreasing a diameter of the snare loop to close the mouth of the bag.

3. The animal waste retrieval device of claim 2, further comprising an annular guide extending about an interior surface of the support ring, the snare loop being positioned into the annular guide, with the bag being positioned within the snare loop and operating to simultaneously retain the snare loop within the annular guide.

4. The animal waste retrieval device of claim 3, wherein the bag is supported at a closed upper end thereof relative to the handle tube by a retaining clip pivotally mounted to the handle tube.

5. The animal waste retrieval device of claim 4, and further comprising a guide member extending from the handle tube and guiding both the actuator and the tension cable such that a pivoting of the actuator towards the handle grip will effect tensioning of the tension cable to operate the closure means.

6. An animal waste retrieval device comprising:

an elongated handle tube having a handle grip coupled to an upper end thereof for facilitating manual grasping and manipulating of the handle tube;

a bag removably coupled to a lower end of the handle tube;

a closure means mounted to the lower end of the handle tube for permitting remote manual closing of the bag when positioned over animal waste to capture and retain the animal waste within the bag;

wherein the closure means comprises a support ring mounted to a lower end of the handle tube, the bag being positioned within the support ring and opened such that an open mouth of the bag is wrapped about the support ring; and elastic band securing the open mouth to the support ring; a snare loop extending along an interior surface of the support ring which can be constricted about the mouth of the bag so as to close the bag and effect simultaneous separation of the mouth of the bag from the exterior of the support ring and the elastic band extending thereabout.

* * * * *